US008651441B2

(12) United States Patent
Brooke

(10) Patent No.: US 8,651,441 B2
(45) Date of Patent: Feb. 18, 2014

(54) SELF-STABILIZING SUPPORT ASSEMBLY FOR AN ITEM OF FURNITURE

(75) Inventor: Rory Brooke, Meyerton (ZA)

(73) Assignee: Hedera AB, Lund (SE)

( * ) Notice: Subject to any disclaimer, the term of this patent is extended or adjusted under 35 U.S.C. 154(b) by 139 days.

(21) Appl. No.: 13/146,825

(22) PCT Filed: Jan. 28, 2010

(86) PCT No.: PCT/IB2010/050381

§ 371 (c)(1),
(2), (4) Date: Dec. 9, 2011

(87) PCT Pub. No.: WO2010/086812

PCT Pub. Date: Aug. 5, 2010

(65) Prior Publication Data

US 2012/0085873 A1 Apr. 12, 2012

Related U.S. Application Data

(60) Provisional application No. 61/148,065, filed on Jan. 29, 2009.

(51) Int. Cl.
*F16M 11/24* (2006.01)

(52) U.S. Cl.
USPC ..... 248/188.3; 108/153.1

(58) Field of Classification Search
USPC ..... 248/188.3, 582, 188.2, 188.7, 592, 431; 108/153.1, 2
See application file for complete search history.

(56) References Cited

U.S. PATENT DOCUMENTS

| | | | | | |
|---|---|---|---|---|---|
| 3,877,669 | A | * | 4/1975 | Ambasz | 248/188.7 |
| 4,178,858 | A | | 12/1979 | Ponzellini | |
| 4,406,437 | A | * | 9/1983 | Wright | 248/529 |
| 4,712,758 | A | | 12/1987 | Cuschera | |
| 4,789,122 | A | * | 12/1988 | Gutgsell | 248/188.7 |
| 5,690,303 | A | * | 11/1997 | Winters | 248/188.3 |

(Continued)

FOREIGN PATENT DOCUMENTS

| | | |
|---|---|---|
| CN | 2569974 | 9/2003 |
| CN | 1590783 | 3/2005 |

(Continued)

*Primary Examiner* — Anita M King
(74) *Attorney, Agent, or Firm* — Hamre, Schumann, Mueller & Larson, P.C.

(57) ABSTRACT

A support assembly for an item of furniture has an elongated support structure with a first pair of feet fast with the support structure at its lower end; a passage defining arrangement defining a guide passage fast with the support structure and extending lengthwise; a support member displaceable with respect to the support structure which has a second pair of feet at its lower end; an elongated a guided pin fast with the displaceable support member that is complementary to and longitudinally slidably engaged with the passage defining arrangement, so that the displaceable support member is slidably displaceable along a rectilinear guide path which is transverse to lines drawn between both the pairs of feet, the passage defining arrangement comprising a hollow carrier with a pair of longitudinally spaced precision washers which engage the guided pin, the dimensions of the washers and the guided pin being such that automatic frictional engagement of the guided pin occurs, in use, with inner walls of the washers in response to pivoting of the displaceable support member about a pivot axis which is transverse to the displaceable support member's guide path, automatically to anchor the displaceable support member frictionally against sliding displacement relative to the support structure.

31 Claims, 2 Drawing Sheets

(56) References Cited

U.S. PATENT DOCUMENTS

Figure 1:
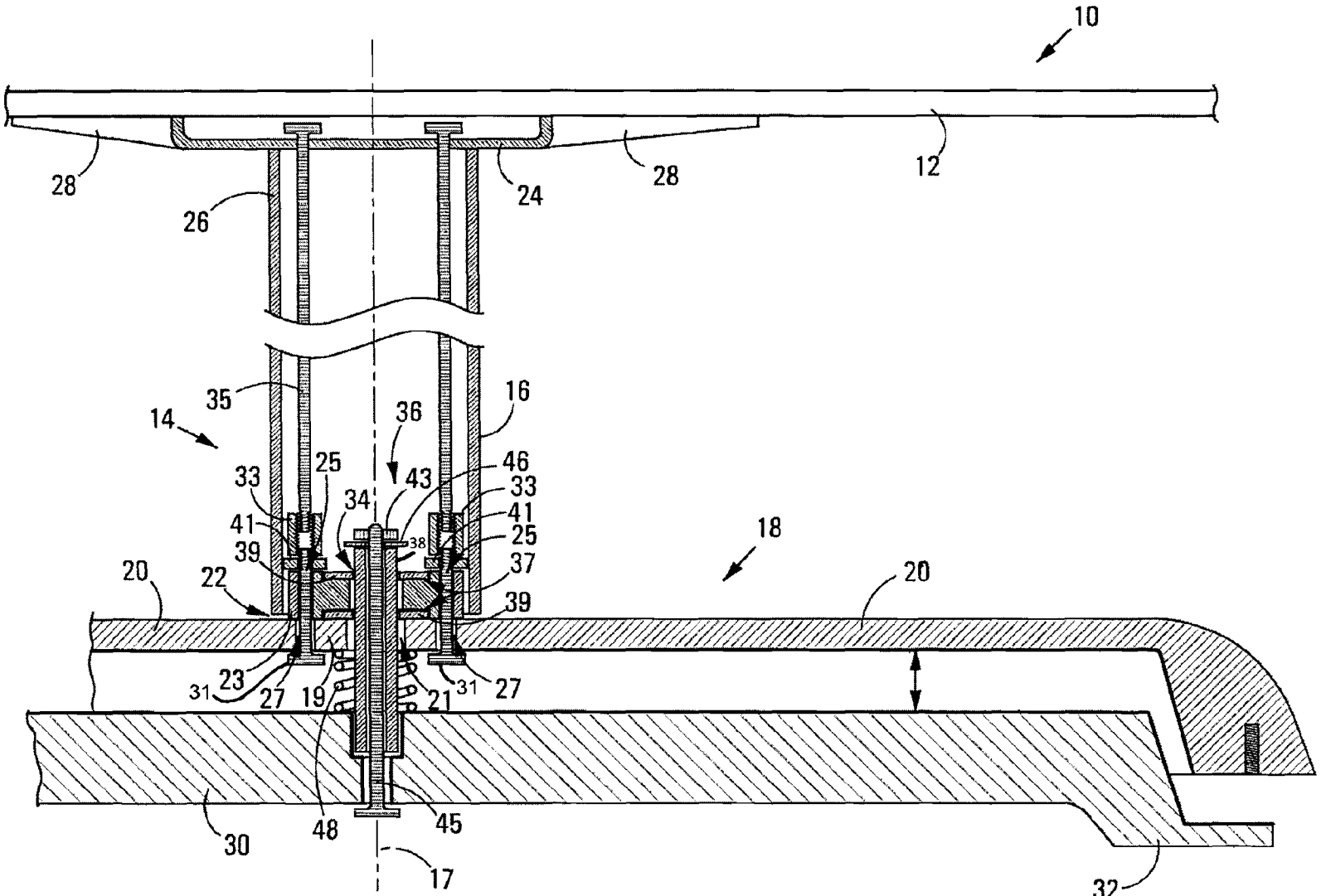

| | | | | |
|---|---|---|---|---|
| 7,111,819 | B2 | 9/2006 | Mikiya et al. | |
| 7,290,741 | B1 | 11/2007 | Cox et al. | |
| 7,677,524 | B2 * | 3/2010 | Brooke | 248/582 |
| 7,930,980 | B2 * | 4/2011 | Brooke | 108/153.1 |
| 2007/0252053 | A1 * | 11/2007 | Brooke | 248/188.3 |
| 2008/0087777 | A1 * | 4/2008 | Christian et al. | 248/188.8 |
| 2012/0091770 | A1 * | 4/2012 | Brooke | 297/311 |

FOREIGN PATENT DOCUMENTS

| | | |
|---|---|---|
| CN | 1882269 | 12/2006 |
| CN | 2879812 | 3/2007 |
| JP | 54-16265 | 2/1979 |
| WO | 2005/034680 | 4/2005 |
| WO | 2006/016199 | 2/2006 |

* cited by examiner

SELF-STABILIZING SUPPORT ASSEMBLY FOR AN ITEM OF FURNITURE

THIS INVENTION relates to furniture. In particular, the invention relates to a support assembly for an item of furniture, and to a self-stabilizing arrangement for an item of furniture. It relates also to an item of furniture.

The invention is expected to be used in the context of tables, stools and chairs, having substantially operatively horizontal tops or seat portions which are supported above a surface on which the table, stool or chair is operatively located. For purposes of this specification, the term "upper portion" is to be understood as including a table top and a seat portion of a stool or chair.

In accordance with one aspect of the invention there is provided a support assembly for an item of furniture, which support assembly includes an elongated support structure for connection at an operatively upper end thereof to an upper portion of an item of furniture;

a first pair of feet fast with the support structure, at or adjacent an operatively lower end thereof;

an elongated guide formation fast with the support structure and extending lengthwise relative to the support structure;

a support member displaceable with respect to the support structure which has a second pair of feet at or adjacent an operatively lower end thereof, the displaceable support member being arranged relative to the support structure so that a line drawn between the feet of the first pair is transverse to a line drawn between the feet of the second pair;

the displaceable support member also being provided with an elongated guided formation complementary to and longitudinally slidably engaged with the guide formation, so that the displaceable support member is slidably displaceable along a rectilinear guide path which is transverse to the lines drawn between both the pairs of feet, with one of the guide formation and the guided formation being in the form of a guided pin, the other one of the guide formation and the guided formation being in the form of a passage defining arrangement defining a guide passage within which the guided pin is longitudinally slidably received, the passage defining arrangement comprising a hollow carrier with a pair of longitudinally spaced precision washers which engage the guided pin, the dimensions of the washers and the guided pin being such that automatic frictional engagement of the guided pin occurs, in use, with inner walls of the washers in response to pivoting of the displaceable support member about a pivot axis which is transverse to the displaceable support member's guide path, automatically to anchor the displaceable support member frictionally against sliding displacement relative to the support structure.

The carrier may have seats in which the washers are received, with retaining members for retaining them therein.

The guide passage may be of circular cross-section, the guided pin being: circular cylindrical.

The guided formation may be constituted by the guided pin, the guided pin projecting operatively upwardly from an operatively upper end of the support member, and the guide formation being constituted by the guide passage defined by the washers of the passage defining arrangement, with the passage defining arrangement being centrally located with respect to the support structure at an operatively lower end thereof.

The support structure may comprise an elongated operatively upright post and a spider formation connected to an operatively lower end of the post, the spider formation comprising four radially outwardly projecting spokes which are equiangularly spaced about a longitudinal axis of the post, each spoke being channel-shaped and opening operatively downwardly, with the passage defining arrangement being removably secured about an aperture in the spider formation and projecting centrally operatively upwardly therefrom.

One pair of aligned spokes may be provided with the first pair of feet, the feet of the first pair respectively being provided at ends of the spokes of said one pair of spokes.

The displaceable support member may comprise an arm which is received in the channel defined by the other pair of aligned spokes and extending lengthwise therealong, the feet of the second pair of feet respectively being provided at the ends of the arm.

The arm and the guided pin may be integrally formed. Instead, the guided pin may be removably secured to the arm.

The support assembly may include at least one urging member urging the arm operatively downwardly away from the support structure. Conveniently, one urging member may be used, being located on the guided pin. Instead the support assembly may include two urging members which are equally spaced on opposite sides of the guided pin, each urging member being in the form of a compressed spring located in the channel defined by said other pair of spokes and acting between the spokes and the arm.

The support assembly may also include a securing formation fast with an operatively upper end of the guided pin, which securing formation together with one of the washers holds the guided pin captive in the passage defining arrangement.

The feet of the second pair may be spaced at equal distances from a longitudinal axis of the guide formation. Further, the feet of the first pair may be spaced the same distance from a longitudinal axis of the guide formation as the feet of the second pair are spaced from the longitudinal axis of the guide formation.

The line drawn between the first pair of feet and the line drawn between; the second pair of feet may be at right angles to each other.

In accordance with another aspect of the invention there is provided a self-stabilizing arrangement for an item of furniture, which arrangement includes:

an elongated first support component having at each end a foot projecting in the same direction;

an elongated guide formation fast with the first support component;

and an elongated second support component having at each end a foot projecting in the same direction as the feet of the first support component, the second support component including an elongated guided formation complementary to and longitudinally slidably engaged with the guide formation, one of the guide formation and the guided formation being in the form of a guided pin, the other one of the guide formation and the guided formation being in the form of a passage defining arrangement fast with the associated one of the first and the second support components and which defines a guide passage within which the guided pin is longitudinally slidably received, such that the second support component is slidably displaceable relative to the first support component, with the passage defining arrangement comprising a hollow carrier with a pair of longitudinally spaced precision washers which define the guide passage.

The washers may be located in seats at opposite ends of the carrier.

The guided formation may be constituted by the guided pin, the guided pin being centrally fast with the second support component and projecting in the opposite direction to the feet, the guide formation being constituted by the passage defining arrangement, the passage defining arrangement being removably secured to and centrally located with respect to the first support component. The first support component and the second support component may be orthogonal.

The arrangement may include a locating arrangement, the locating arrangement keeping the first and the second support components in a predetermined relative configuration.

The locating arrangement may include a pair of longitudinally aligned spokes fast with the first support component and projecting radially outwardly therefrom, such that the spokes and the first support component are orthogonal, the spokes being shaped to define a locating channel opening in the same direction as the direction in which the feet project, the second support component being located in a channel defined by one pair of aligned spokes.

The guide formation and the precision washers may be shaped and dimensioned such that there is limited clearance between the guided pin and inner walls of the washers, so that automatic frictional locking of the second support component relative to the first support component occurs when a nett moment about an axis transverse to a longitudinal axis of the guided pin is exerted on the second support component.

The arrangement may include at least one urging member urging the second support component away from the first support component in the same direction in which the feet project. The arrangement may include only one urging member mounted on the guided pin or two urging members which are! equally spaced on opposite sides of the guide formation, each urging member being in the form of a compressed spring located in the channel defined by said other pair of spokes and acting between the spokes and the second support component.

The arrangement may include a securing formation for securing it, in use, to a support structure of an item of furniture.

The arrangement may include a securing formation fast with the guided pin, which securing formation serves to hold the guided pin captive in the passage defining arrangement.

In accordance with yet another aspect of the invention there is provided an item of furniture which includes a support assembly as hereinbefore described, and an upper portion of an item of furniture mounted on the support assembly.

The item of furniture may be a table, the upper portion of the item of furniture being a table top. Instead, the item of furniture may be a stool or a chair, the upper portion of the item of furniture being a seat portion of the stool or chair.

In accordance with still another aspect of the invention there is provided an item of furniture which includes a self-stabilizing arrangement as hereinbefore described, and an upper portion of an item of furniture fast with the first support component thereof.

The item of furniture may be a table, the upper portion of the item of furniture being a table top. Instead, the item of furniture may be a stool or a chair, the upper portion of the item of furniture being a seat portion of the stool or chair.

Figure 2:
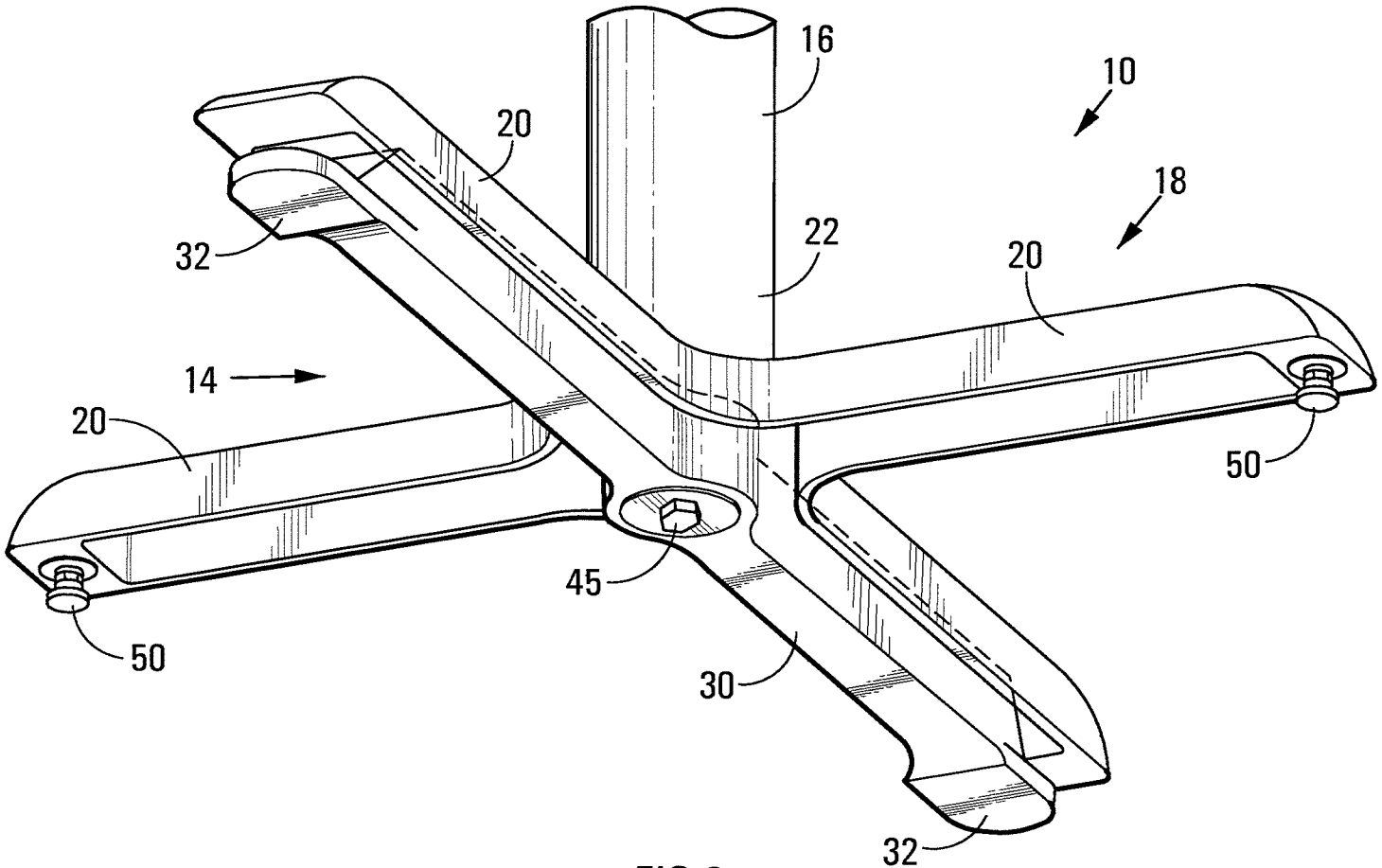

The invention will now be further described, by way of a non-limiting example, with reference to the accompanying schematic drawings, in which:

FIG. 1 shows, fragmentarily and on an enlarged scale, a sectional side elevation of a table in accordance with the invention, the table including the support assembly in accordance with the invention 1; and FIG. 2 shows a three-dimensional view from below of the table.

Referring to FIG. 1 of the drawings, reference numeral 10 generally indicates a table in accordance with the invention. The table 10 comprises an upper portion in the form of a table top 12 (not sectioned) mounted on a support assembly 14 in accordance with the invention. The support assembly 14, in turn, comprises an operatively upright elongated tubular hollow post 16 and a spider formation 18 which includes four radially projecting equiangularly spaced spokes 20 secured to a lower end 22 of the post 16. The spider formation 18 is shaped such that a plane defined by the spokes 20 is normal to a longitudinal axis 17 of the post 16. A mounting member 24 is connected to an upper end 26 of the post 16, the mounting member 24 comprising a series of four equiangularly spaced mounting flanges 28. Each mounting flange 28 has a pair of apertures (not shown) therethrough, through which apertures screws (also not shown) are passed, the screws being screwed into the table top 12, to mount the table top 12 on the support assembly 14.

Each spoke 20 is channel-shaped and opens downwardly, thus having an inverted U-shape in cross-sectional profile. A displaceable support member in the form of an elongated displaceable arm 30 is received in one pair of aligned spokes 20, extending lengthwise along the said pair of spokes 20. The displaceable arm 30 is of mild steel construction, being in the form of a casting. The displaceable arm 30 provides a downwardly projecting foot 32 at each end thereof. The spider formation 18 forms a locating arrangement for keeping the displaceable arm 30 perpendicular to the other pair of spokes 20 by restricting pivotal displacement of the displaceable leg 30 about the longitudinal axis 17 of the post 16.

The support assembly 14 includes a passage defining arrangement 36 which is secured to a center portion 19 of the spider 18 about an opening 21 therein, to be located centrally with respect to the spokes 20. The passage defining arrangement 36 comprises a hollow carrier 23 which has a central bore and two spaced securing bores 25 which align with associated holes 27 in the spider 18. The carrier 23 is secured to the spider 18 by means of bolts 31 and nuts 33. The nuts 33 also serve to secure the post 16 to the spider 18 by means of long bolts 35 that pass through aligned holes in the mounting member 24. The carrier 23 has a seat 37 at each end of its bore in each of which a precision washer 39 is located. An inner precision washer 39 is retained by the spider 18 and an outer precision washer 39 is retained by retaining washers 41. It will be appreciated that the precision washers 39 define a guide passage 34.

A guided formation in the form of a circular cylindrical guided pin 38 projects upwardly from the arm 30, being secured thereto by a nut 43 and bolt 45. The guided pin 38 is coaxial with the post 16. The guided pin 38 is longitudinally slidably received in the guide passage 34, so that the guided pin 38 is displaceable in the passage defining arrangement 36. The guided pin 38 constitutes a guided formation, the passage defining arrangement 36 constituting a guide formation.

The pin 38 has a central bore through which the shank of the bolt 45 passes.

A stop washer 46 is held by the nut 43. The stop washer 46 has a diameter which is greater than the inner diameter of the outer precision washer 39 so that the washer 46 limits sliding displacement of the pin 38 in the passage 34.

The support assembly 12 includes a coiled spring 48 under compression, about the pin 38 between the arm 30 and the spider formation 18, to urge the arm 30 operatively downwardly away from the spider formation 18.

As can be seen in FIG. 2 of the drawings, the spokes 20 of the other pair of aligned spokes 20, i.e. the spokes 20 which extend perpendicularly to the arm 30, are each, at their outer ends, provided with an operatively downwardly projecting fixed foot 50. Said pair of spokes 20 thus forms a first support member which has a foot 50 at each end thereof. The spider formation 18 thus constitutes a locating: arrangement, keeping the arm 30 perpendicular to the other pair of spokes 20 by restricting swivelling of the arm 30 about the passage 34.

The diameter of the guide passage 34 as defined by the precision washers 39 is such that there is limited clearance between the guided pin 38 and the inner walls of the precision washers 39, so that there is frictional locking of the guided pin 38 when a couple, or a nett moment about an axis transverse to a longitudinal axis of the guided pin 38 is exerted on the arm 30, which typically happens when the table 10 is located on an uneven surface. The arm 30 is thus only slidably displaceable in the guide passage 34 when there is substantially no nett moment acting on the arm 30 about an axis coaxial with a line drawn between the two fixed feet 50.

The support assembly 14 without the post 16 thus defines a self stabilizing arrangement in accordance with the invention. In use, the support assembly 14 supports the table top 12 on a support; surface such as the ground (not shown). When the ground surface is uneven, the support assembly 14 is automatically operable to displace the arm 30 relative to the spider formation 18 such that all four feet 50, 32 bear against the support surface.

When, for instance, the ground is uneven such that both of the fixed feet bear against the ground, but only one of the displaceable feet 32 at a time touches the ground, the table 10 will tend to rock by pivoting of the spider formation 18 about the axis aligned with a line interconnecting the fixed feet 50. During such rocking, the displaceable arm 30 is urged downwardly by the springs 48 when both feet 32 are clear of the ground, i.e. when no external forces are exerted on the feet 32, the arm 30, via the guided pin 38, being automatically locked in position in the passage defining arrangement 36 when either of the feet 32 abut against the ground. The displaceable arm 30 thus automatically finds a position where both its feet 32, as well as the fixed feet 50 bear against the ground.

In instances where the ground is uneven such that both the displaceable feet 32, but only one of the fixed feet 50, bear against the ground, the arm 30 is displaced upwardly with its guided pin 38 moving in the guide passage 34 until both the fixed feet 50 bear against the ground surface. It will be appreciated that, in order for the arm 30 to be in equilibrium, upward forces exerted by the ground on the displaceable feet 32 must be equal to each other. This is because the feet 32 are equally spaced from the guided pin 38. These equal upward forces cause upward displacement of the arm 30 against the urging of the spring 48 until the table support structure 14 attains a stable, static condition.

Once all four feet 32, 50 bear against the ground, the table 10 remains stable, as the arm 30, and therefore the feet 32, is effectively locked in position. This is because any attempt at rocking the table 10 will result in the application of unequal forces to the feet 32, causing automatic and immediate frictional locking of the arm 30, via the guided pin 38 in the passage defining arrangement 36.

The invention claimed is:

1. A support assembly for an item of furniture, which support assembly includes:

an elongated support structure for connection at an operatively upper end thereof to an upper portion of an item of furniture;

a first pair of feet fast with the support structure, at or adjacent an operatively lower end thereof;

an elongated guide formation fast with the support structure and extending lengthwise relative to the support structure;

a support member displaceable with respect to the support structure which has a second pair of feet at or adjacent an operatively lower end thereof, the displaceable support member being arranged relative to the support structure so that a line drawn between the feet of the first pair is transverse to a line drawn between the feet of the second pair;

the displaceable support member also being provided with an elongated guided formation complementary to and longitudinally slidably engaged with the guide formation, so that the displaceable support member is slidably displaceable along a rectilinear guide path which is transverse to the lines drawn between both the pairs of feet, with one of the guide formation and the guided formation being in the form of a guided pin, the other one of the guide formation and the guided formation being in the form of a passage defining arrangement defining a guide passage within which the guided pin is longitudinally slidably received, the passage defining arrangement comprising a hollow carrier with a pair of longitudinally spaced precision washers which engage the guided pin, the dimensions of the washers and the guided pin being such that automatic frictional engagement of the guided pin occurs, in use, with inner walls of the washers in response to pivoting of the displaceable support member about a pivot axis which is transverse to the displaceable support member's guide path, automatically to anchor the displaceable support member frictionally against sliding displacement relative to the support structure.

2. The support assembly as claimed in claim 1, in which the carrier has seats in which the washers are received and the passage defining arrangement includes retaining members for retaining the washers in the seats.

3. The support assembly as claimed in claim 1, in which the guide passage is of circular cross-section and the guided pin is circular cylindrical.

4. The support assembly as claimed in claim 1, in which the guided formation is constituted by the guided pin, the guided pin projecting operatively upwardly from an operatively upper end of the support member, and the guide formation is constituted by the guide passage defined by the washers of the passage defining arrangement, with the passage defining arrangement being centrally located with respect to the support structure at an operatively lower end thereof.

5. The support assembly as claimed in claim 1, in which the support structure comprises an elongated operatively upright post and a spider formation connected to an operatively lower end of the post, the spider formation comprising four radially outwardly projecting spokes which are equiangularly spaced about a longitudinal axis of the post, each spoke being channel-shaped and opening operatively downwardly, with the passage defining arrangement being removably secured about an aperture in the spider formation and projecting centrally operatively upwardly therefrom.

6. The support assembly as claimed in claim 5, in which a first pair of aligned spokes may be provided with the first pair of feet, at their respective ends.

7. The support assembly as claimed in claim 6, in which the displaceable support member comprises an arm which is received in the channel defined by a second pair of aligned spokes and extending lengthwise therealong, the feet of the second pair of feet respectively being provided at the ends of the arm.

8. The support assembly as claimed in claim 4, in which the guided pin is removably secured to the arm.

9. The support assembly as claimed in claim 1, which includes at least one urging member for urging the displaceable support member away from the support structure.

10. The support assembly as claimed in claim 9, in which the urging member is aligned with the guided pin.

11. The support assembly as claimed in claim 9, which includes a pair of urging members equally spaced on opposite sides of the guided pin.

12. The support assembly as claimed in claim 1, which includes a securing formation fast with a free end of the guided pin, which securing formation together with one of the washers holds the guided pin captive in the passage defining arrangement.

13. The support assembly as claimed in claim 1, in which the second pair of feet are spaced at equal distances from a longitudinal axis of the guide formation.

14. The support assembly as claimed in claim 13, in which the first pair of feet are spaced the same distance from a longitudinal axis of the guide formation as the second pair of feet are spaced from the longitudinal axis of the guide formation.

15. The support assembly as claimed in claim 1, in which the line drawn between the first pair of feet and the line drawn between the second pair of feet are at right angles to each other.

16. A self-stabilizing arrangement for an item of furniture, which arrangement includes:

an elongated first support component having at each end a foot projecting in the same direction;

an elongated guide formation fast with the first support component;

and an elongated second support component having at each end a foot projecting in the same direction as the feet of the first support component, the second support component including an elongated guided formation complementary to and longitudinally slidably engaged with the guide formation, one of the guide formation and the guided formation being in the form of a guided pin, the other one of the guide formation and the guided formation being in the form of a passage defining arrangement fast with the associated one of the first and the second support components and which defines a guide passage within which the guided pin is longitudinally slidably received, such that the second support component is slidably displaceable relative to the first support component, with the passage defining arrangement comprising a hollow carrier with a pair of longitudinally spaced precision washers which define the guide passage.

17. The self-stabilizing arrangement for an item of furniture as claimed in claim 16, in which the washers are located at opposite ends of the carrier.

18. The self-stabilizing arrangement for an item of furniture as claimed in claim 17, in which the washers are located in seats at opposite ends of the carrier.

19. The self-stabilizing arrangement for an item of furniture as claimed in claim 16, in which the guided formation is constituted by the guided pin, the guided pin being centrally fast with the second support component and projecting in the opposite direction to the feet; and the guide formation is constituted by the passage defining arrangement, the passage defining arrangement being removably secured to and centrally located with respect to the first support component.

20. The self-stabilizing arrangement for an item of furniture as claimed in claim 16, in which the first support component and the second support component are orthogonal.

21. The self-stabilizing arrangement for an item of furniture as claimed in claim 16, which includes a locating arrangement for keeping the first and the second support components in a predetermined relative configuration.

22. The self-stabilizing arrangement for an item of furniture as claimed in claim 21, in which the locating arrangement includes a pair of longitudinally aligned spokes fast with the first support component and projecting radially outwardly therefrom, such that the spokes and the first support component are orthogonal, the spokes being shaped to define a locating channel opening in the same direction as the direction in which the feet project, the second support component being located in a channel defined by one pair of aligned spokes.

23. The self-stabilizing arrangement for an item of furniture as claimed in claim 16, in which the guide formation and the precision washers are shaped and dimensioned such that there is limited clearance between the guided pin and inner walls of the washers, so that automatic frictional locking of the second support component relative to the first support component occurs when a nett moment about an axis transverse to a longitudinal axis of the guided pin is exerted on the second support component.

24. The self-stabilizing arrangement for an item of furniture as claimed in claim 16, which includes at least one urging member for urging the second support component away from the first support component in the same direction in which the feet project.

25. The self-stabilizing arrangement for an item of furniture as claimed in claim 16, which includes a securing formation fast with the guided pin for holding the guided pin captive in the passage defining arrangement.

26. An item of furniture which includes a support assembly as claimed in claim 1 and an upper portion of an item of furniture mounted on the support assembly.

27. The item of furniture as claimed in claim 26, which is a table, the upper portion of the item of furniture being a table top.

28. The item of furniture as claimed in claim 26, which is a seating device, the upper portion of the item of furniture being a seat portion of the seating device.

29. An item of furniture which includes a self-stabilizing arrangement as claimed in claim 16 and an upper portion of an item of furniture fast with the first support component thereof.

30. An item of furniture as claimed in claim 29, which is a table, the upper portion of the item of furniture being a table top.

31. An item of furniture as claimed in claim 29, which is a seating device, the upper portion of the item of furniture being a seat portion of the seating device.

* * * * *